US006065716A

United States Patent [19]

Münster

[11] Patent Number: 6,065,716

[45] Date of Patent: May 23, 2000

[54] SELF-ALIGNMENT ELEMENT FOR A SPOOL HAVING WOUND WEB THEREON

[75] Inventor: Bruno Münster, Bad Ditzenbach, Germany

[73] Assignee: Eastman Kodak Company, Rochester, N.Y.

[21] Appl. No.: 09/210,265

[22] Filed: Dec. 10, 1998

[30] Foreign Application Priority Data

Dec. 24, 1997 [DE] Germany ..... 197 57 900

[51] Int. Cl.[7] ..... B65H 16/04; B65H 75/14

[52] U.S. Cl. ..... 242/597.6; 242/611; 242/614

[58] Field of Search ..... 242/597.6, 597.8, 242/611, 611.1, 611.2, 613.4, 613.5, 614

[56] References Cited

U.S. PATENT DOCUMENTS

| | | |
|---|---|---|
| 1,604,192 | 10/1926 | Parker . |
| 1,829,482 | 10/1931 | Hayden . |
| 2,261,841 | 11/1941 | Booth . |
| 2,339,372 | 1/1944 | Bennett . |
| 3,042,180 | 7/1962 | Bishop . |
| 3,253,796 | 5/1966 | Jackson . |
| 3,275,257 | 9/1966 | Cherniavskyj . |
| 3,323,743 | 6/1967 | Landgraf . |
| 3,330,494 | 7/1967 | Rissberger, Jr. . |
| 3,486,709 | 12/1969 | Roberson . |
| 3,499,611 | 3/1970 | Franck . |
| 3,735,941 | 5/1973 | Brown et al. . |
| 3,840,193 | 10/1974 | Feichtinger et al. . |
| 4,723,731 | 2/1988 | Posso . |

FOREIGN PATENT DOCUMENTS

| | | |
|---|---|---|
| 0 401 036 A1 | 6/1990 | European Pat. Off. . |
| 0 401 036 | 12/1990 | European Pat. Off. . |
| 2 162 493 | 2/1986 | United Kingdom . |

*Primary Examiner*—Donald P. Walsh
*Assistant Examiner*—William A. Rivera
*Attorney, Agent, or Firm*—Clyde E. Bailey, Sr.

[57] ABSTRACT

A spool for thread-type or strip-type wound material in a version for correct-sided insertion into a device, the spool on the one hand having a substantially cylindrical tube-type or cylindrical double tube-type winding core with flange disks of greater diameter arranged at its two ends for forming a winding area, and on the other hand being fittable inside the apparatus in a predetermined operating position with its central mounting bore arranged in the winding core and rotatable about its central axis. To obtain a spool that has on the one hand a simple and inexpensive structure and permits a simple, compact, and inexpensive configuration of the apparatus receiving the spool and on the other hand is versatile in use, i.e. for wound materials of differing winding directions and materials, while at the same time permitting safe and simple handling of the spools with differing wound materials and ensuring the respectively predetermined operating position of the spool inside the apparatus, at least one insertion direction/position determining means at a distance radially from the mounting bore is arranged on the outside of at least on one of the flange disks of the spool such that wrong-sided fitting of the spool on a mounting journal is recognizable and an axial movement of the spool into its predetermined operating position on the mounting journal is preventable when it has been fitted on the wrong side.

12 Claims, 2 Drawing Sheets

SELF-ALIGNMENT ELEMENT FOR A SPOOL HAVING WOUND WEB THEREON

CROSS-REFERENCE TO RELATED APPLICATIONS

The present application claims priority of German Patent Application No. 19757900.0, filed Dec. 24, 1997, titled "Spool For Thread-Type or Strip-Type Wound Material," by Bruno Munster.

FIELD OF THE INVENTION

The invention relates generally to the field of spool devices, and in particular to a spool for thread-type or strip-type wound material in a version for correct-sided insertion into a device.

BACKGROUND OF THE INVENTION

A spool for strip-type wound material (paper roll) in a version for correct-sided insertion into a printer in accordance with the generic type is known from EP Application No. 0 401 036, filed Jun. 01, 1990, by Takeuchi, et al. with the spool having a tapered mounting bore for the purpose of correct-sided fitting on two mounting journals of the apparatus that are axially separated from one another.

The disadvantage of this is that the contact surface formed between the mounting bore of the spool and the two mounting journals of the apparatus is relatively small, which leads to heavy strain on the affected bearing parts when the wound material has a high weight. In addition, the requirement for and the use of two mounting journals makes the configuration of the apparatus complicated. Furthermore, spools with differing wound materials, or with the same wound material but opposite winding direction relative to the tapered mounting bore determining their insertion direction, cannot be distinguished when they are fitted on the mounting journals and their use in the correct-sided operating position on the mounting journal relative to the wound material is therefore only guaranteed by using additional scanning means on one of the flange disks and an expensive electronic or optoelectronic scanning device inside the apparatus.

The object underlying the present invention is therefore to provide a spool of the generic type that on the one hand has a simple and inexpensive structure and permits a simple, compact, and inexpensive configuration of the apparatus receiving the spool, and on the other hand is versatile in use, i.e. for wound materials of differing winding directions and materials, while at the same time permitting safe and simple handling of the spools with differing wound materials and ensuring the respectively predetermined operating position of the spool inside the apparatus, with functioning in an automated environment also being assured.

The object is attained in accordance with the invention by a spool in that at least one insertion direction/position determining means at a distance radially from the mounting bore is arranged on the outside of at least one of the flange disks of the spool such that wrong-sided fitting of the spool on a mounting journal is recognizable and an axial movement of the spool into its predetermined operating position on the mounting journal is preventable when it has been fitted on the wrong side. The insertion direction/position determining means on the flange disk is advantageously configured as a projection or depression concentrically arranged about the central axis, in particular about the mounting bore of the spool.

Furthermore, first and second annular insertion direction/position determining means are advantageously provided on one of the flange disks of the spool and are arranged concentrically and at a radially differing distance to the mounting bore, or a first or second annular insertion direction/position determining means is provided on each of the flange disks of the spool and is arranged concentrically and at a radially differing distance to the mounting bore, with the insertion direction/position determining means each being assigned to one winding direction of the wound material or to one type of wound material.

SUMMARY OF THE INVENTION

The present invention is directed to overcoming one or more of the problems set forth above. Briefly summarized, according to one aspect of the present invention, a spool for thread-type or strip-type wound material in a version for correct-sided insertion into an apparatus, with the spool on the one hand having a substantially cylindrical tube-type or cylindrical double tube-type winding core with flange disks of greater diameter arranged at its two ends for forming a winding area, and on the other hand being fittable inside the apparatus in a predetermined operating position with its central mounting bore arranged in the winding core and rotatable about its central axis, the spool comprising at least one insertion direction/position determining means at a distance radially from the mounting bore, said at least one insertion direction/position determining means being arranged on the outside of at least one of the flange disks of the spool such that wrong-sided fitting of the spool on a mounting journal is recognizable and an axial movement of the spool into its predetermined operating position on the mounting journal is preventable when it has been fitted on the wrong side.

These and other aspects, objects, features, and advantages of the present invention will be more clearly understood and appreciated from a review of the following detailed description of the preferred embodiments and appended claims, and by reference to the accompanying drawings.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
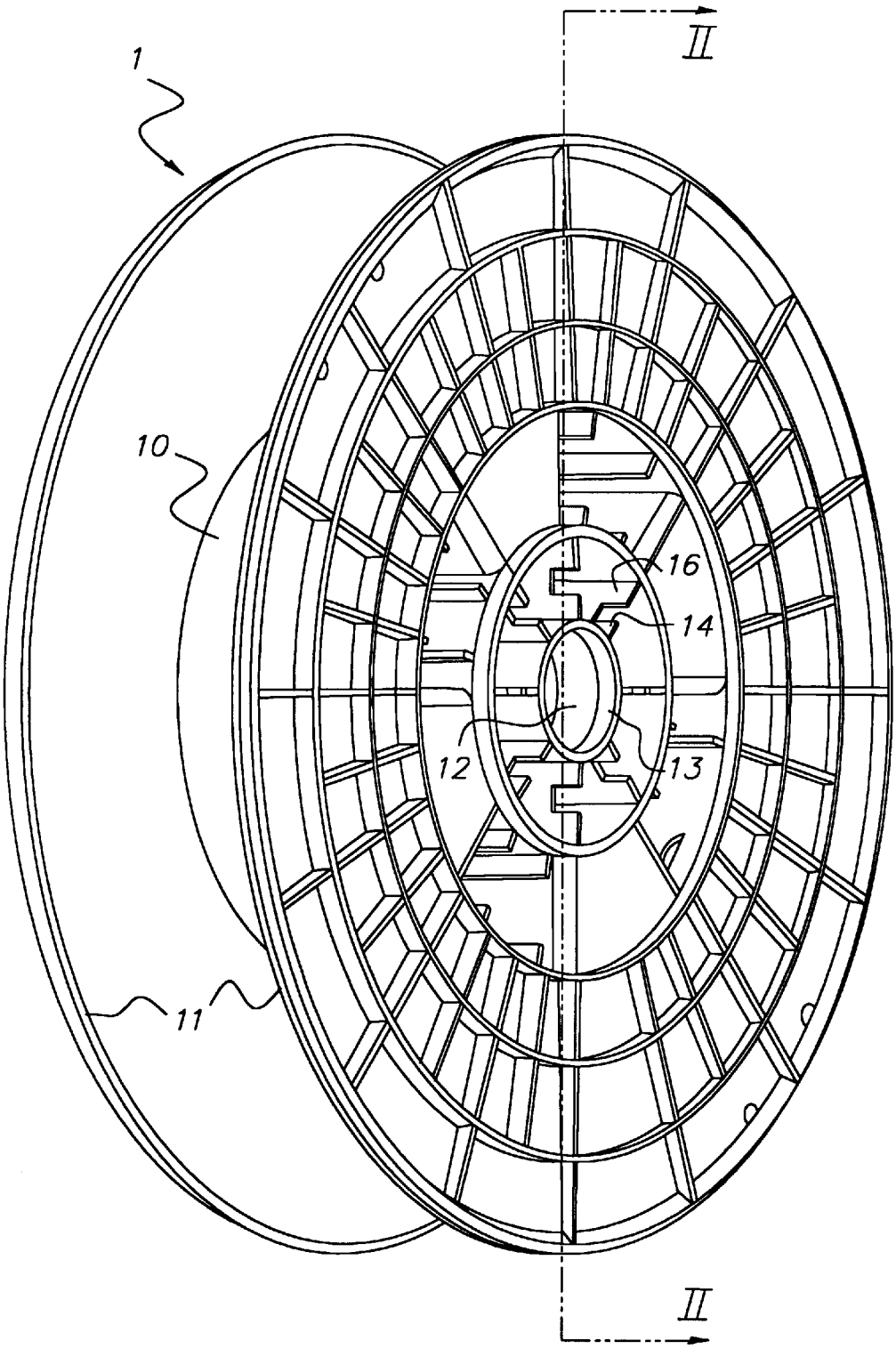
FIG. 1 is a spool in accordance with the invention with insertion direction/position determining means in a spatial view.
Figure 2:
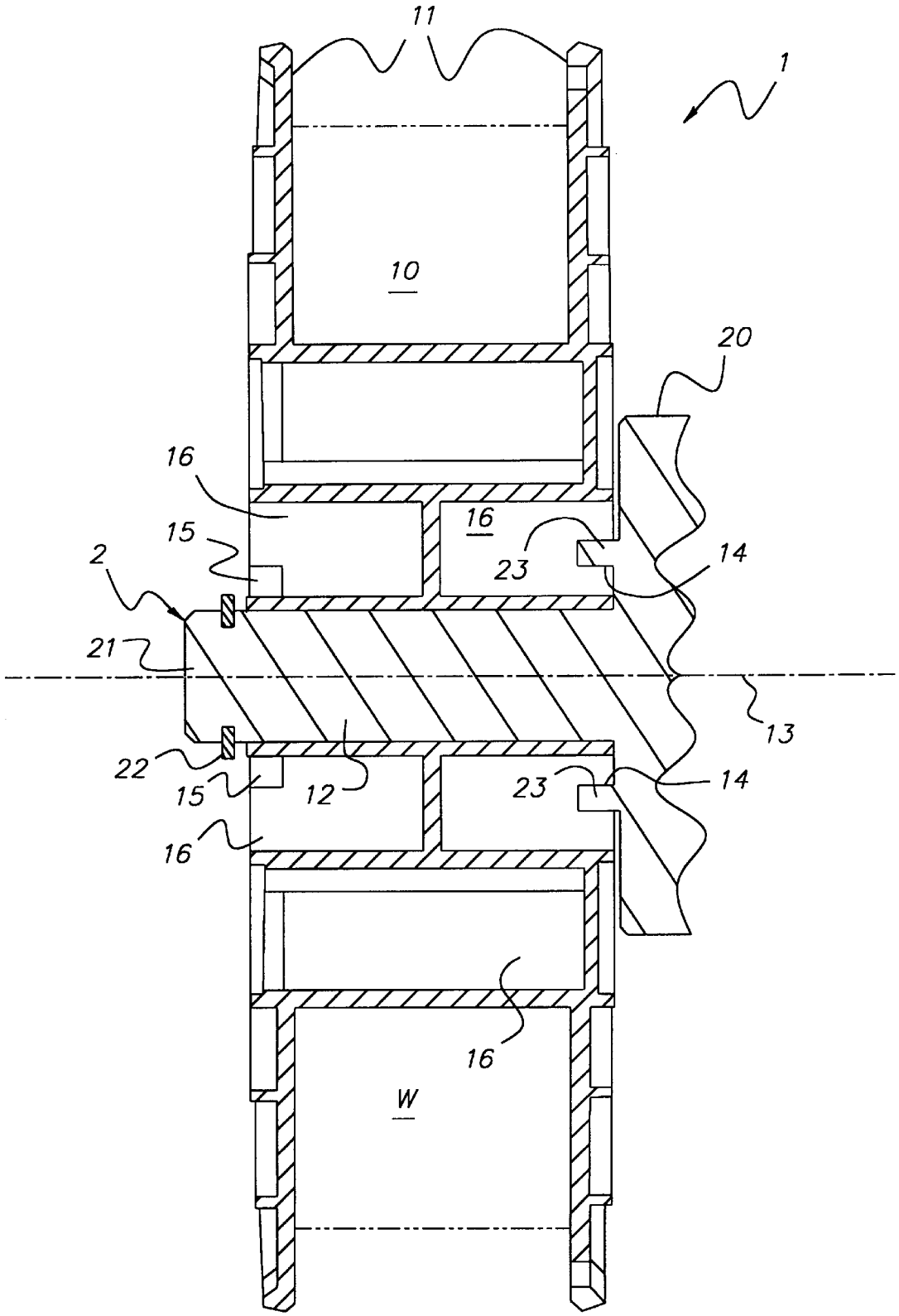
FIG. 2 is a spool according to FIG. 1 in a sectional view along the line II—II with the spool being arranged on a mounting journal of an apparatus.

The following description according to FIGS. 1 and 2 relates to a preferred embodiment of the spool 1 in accordance with the invention for thread-type or strip-type wound material in a version for correct-sided insertion into an apparatus, with the spool on the one hand having a substantially cylindrical tube-type or cylindrical double tube-type winding core 10 with flange disks 11 of greater diameter arranged at its two ends for forming a winding area 4, and on the other hand being fittable inside the apparatus in a predetermined operating position with its central mounting bore 12 arranged in the winding core 10 and rotatable about its central axis 13.

The spool 1 is, as shown in FIG. 2, insertable onto a mounting journal 2 of an apparatus of known type, not shown, for example in a sheet-stacking/stapling apparatus of a copier, and is preferably loaded with stapling wire as the wound material.

It is of course obvious for a person skilled in the art in this particular field that the inventive device can also be fitted in other apparatus, for example in printing equipment, and with different wound material, for example staples lined up on a belt, with the wound material being able to have different winding directions.

The spool 1 in accordance with the invention and shown in FIGS. 1 and 2 is characterized in that a first insertion direction/position determining means 14 at a distance radially from the mounting bore 12 is arranged on the outside of one of the flange disks 11, with the first insertion direction/position determining means 14 on the flange disk 11 being configured as a depression concentrically arranged about the central axis 13, in particular about the mounting bore 12 of the spool 1, i.e. arranged in the outside stiffening ribs 16 of the flange disk or the winding core 10 as an annular/all-round groove or channel. In an alternative embodiment, not shown, the insertion direction/position determining means 14 is arranged in a smooth outer surface of the flange disk 11 of the spool 1 without stiffening ribs 16.

As shown in FIG. 2, on the one hand the mounting journal 2 for receiving the spool 1 has at its first end connected to the apparatus a contact disk 20 for the facing flange disk 11 of a fitted spool, and on the other hand a locking means 22, for example a C-shaped and spring-elastic lock washer fitting onto a groove all round the mounting journal end, is provided at the second end 21 of the mounting journal 2, by which washer the fitted spool is movable into and securable in its axial operating position.

The contact disk 20 is provided on the mounting journal 2 as an annular disk-shaped contact surface which is plane-parallel to the flange disk 11 of the spool 1 and which has a first insertion direction/position determining means 23 in the form of an annular all-round projection (e.g. a bead or bulge) fitting positively and in the correct position, such that wrong-sided fitting of the spool 1 on the mounting journal 2 of the apparatus is recognizable and an axial movement or displacement of the spool 1 into its predetermined operating position on the mounting journal 2 is preventable when it has been fitted on that mounting journal 2 on the wrong side.

As shown in FIG. 2, first and second annular insertion direction/position determining means (14 and 15) are provided on each of the flange disks 11 of the spool 1 in the form of an annular all-round groove or channel arranged concentrically and at radially differing (large or small) distances from the mounting bore 12. This permits the use or fitting of the spool 1 on at least two mounting journals 2 arranged separately in the apparatus with differing insertion direction/position determining means (the first 23 and the second 24) on the contact surfaces, such that the spool is movable and alignable into the operating position on the respective mounting journal with differing lateral alignment, but correct-sided. As a result, the insertion direction/position determining means 14, 15 of the spool 1 and the complementary first and second insertion direction/position means 23, 24 of the mounting journal 2 are each assigned or assignable to one winding direction of the wound material 4 or to one type of wound material.

Due to the concentrically arranged and annular all-round insertion direction/position determining means 14,15 and 23, 24 on the flange disks 11 of the spool 1 and on the contact disk 20 of the mounting journal(s) 2, the spool 1 is freely rotatable on a fixed mounting journal 2, or—as in an alternative embodiment, not shown—freely rotatable together with the mounting journal 2.

In an alternative embodiment, not shown, of the spool 1, first and second annular insertion direction/position determining means 14, 15, respectively, are jointly arranged on one of the flange disks 11 of the spool 1 and concentrically and at radially differing distances from the mounting bore 12. The result of this is that spools 1 with differing wound material 4 are assigned to different mounting journals 2, while maintaining the same lateral alignment and correct operating position of the spools 1 on the respective mounting journal 2 in the apparatus or in different apparatus.

In a further alternative embodiment, not shown, the insertion direction/position determining means 14, 15 of the spool 1 is/are designed as concentrically arranged annular all-round projection(s), in particular bead(s) or bulge(s), with the contact surface of the contact disk 20 having complementarily configured first and second insertion direction/position determining means 23, 24. In the event that only one insertion direction/position determining means 14 in the form of a projection is arranged on the spool 1, the contact surface of the contact disk 20 can be designed without first insertion direction/position determining means 23, with the spool 1 in its correct-sided operating position however being in contact with the plane contact disk 20 of the mounting journal 2 by the flange disk 11 without insertion direction/position determining means 14.

The invention has been described with reference to a preferred embodiment; However, it will be appreciated that variations and modifications can be effected by a person of ordinary skill in the art without departing from the scope of the invention.

1 spool
2 mounting journal
4 winding area
10 winding core
11 flange disks
12 mounting bore
13 central axis
14 first insertion direction/position determining means
15 second insertion direction/position determining means
16 stiffening ribs
20 contact disk
21 second end of mounting journal
22 locking means
23 first insertion direction/position determining means
24 second insertion direction/position determining means

What is claimed is:

1. A spool for thread-type or strip-type wound material for correct-sided insertion into an apparatus comprising:

a substantially cylindrical winding core having a central axis passing therethrough, said winding, core having a flange disk of greater diameter arranged on opposing ends of said winding core forming a winding area therebetween, said spool being fittable inside the apparatus in a predetermined operating position with a central mounting bore arranged in the winding area of said core and rotatable about said central axis of said winding core; at least one insertion direction/position determining means arranged at a distance radially from the mounting bore, said at least one insertion direction/position determining means being arranged on at least one of the flange disks such that wrong-sided fitting of the spool on a mounting journal is recognizable and an axial movement of the spool into its predetermined operating position on the mounting journal is preventable when it has been fitted on the wrong side; wherein said insertion direction/position determining means on the flange disk is configured as an annular feature concentrically arranged about the central axis.

2. The spool according to claim 1, wherein first and second annular insertion direction/position determining means are provided on one of the flange disks of the spool and arranged concentrically and at radially differing distances from the mounting bore.

3. The spool according to claim 1, wherein first or second annular insertion direction/position determining means are provided on each of the flange disks of the spool and arranged concentrically and at radially differing distances from the mounting bore.

4. The spool according to claim 1, wherein the insertion direction/position determining means are arranged in outer surfaces stiffened by ribs of the flange disks.

5. The spool according to claim 1, wherein the insertion direction/position determining means are each assigned to one winding direction of the wound material.

6. The spool according to claim 1, wherein the wound material is stapling wire.

7. The spool according to claim 1 wherein the mounting journal for receiving the spool has at its first end a contact disk for the facing flange disk of a fitted spool, and a locking means is provided at the second end of the mounting journal, by which means the fitted spool is movable into and securable in its axial operating position.

8. The spool according to claims 7, wherein the contact disk on the mounting journal is an annular disc-shaped contact surface which is plane-parallel to the flange disk and, said contact disk having first and second insertion direction/position determining means in the form of projections fitting positively with the flange disks of the spool, and in that at least two mounting journals with differing insertion direction/position determining contact surfaces for the spools are arranged in the apparatus.

9. The spool according to claim 7, wherein the spool in the operating position is freely rotatable on the mounting journal.

10. The spool recited in claim 1 wherein said annular feature is a projection concentrically arranged about said central axis.

11. The spool recited in claim 1 wherein said annular feature is depression concentrically arranged about said central axis.

12. The spool recited in claim 1 wherein said annular feature is arranged about the mounting bore of the spool.

* * * * *